US009506137B2

(12) United States Patent
Koyama et al.

(10) Patent No.: US 9,506,137 B2
(45) Date of Patent: Nov. 29, 2016

(54) GAS-CARBURIZED STEEL PART EXCELLENT IN SURFACE FATIGUE STRENGTH, STEEL PRODUCT FOR GAS CARBURIZING, AND MANUFACTURING METHOD OF GAS-CARBURIZED STEEL PART

(75) Inventors: Tatsuya Koyama, Tokyo (JP); Manabu Kubota, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 586 days.

(21) Appl. No.: 13/580,601

(22) PCT Filed: Dec. 7, 2011

(86) PCT No.: PCT/JP2011/078275

§ 371 (c)(1),
(2), (4) Date: Aug. 22, 2012

(87) PCT Pub. No.: WO2012/077705

PCT Pub. Date: Jun. 14, 2012

(65) Prior Publication Data

US 2012/0312425 A1 Dec. 13, 2012

(30) Foreign Application Priority Data

Dec. 8, 2010 (JP) ..... 2010-273856

(51) Int. Cl.

| | |
|---|---|
| ***C22C 38/34*** | (2006.01) |
| ***C23C 8/22*** | (2006.01) |
| ***C21D 1/06*** | (2006.01) |
| ***C21D 1/32*** | (2006.01) |
| ***C21D 1/76*** | (2006.01) |
| ***C21D 6/00*** | (2006.01) |
| ***C22C 38/00*** | (2006.01) |
| ***C22C 38/04*** | (2006.01) |
| ***C22C 38/06*** | (2006.01) |
| ***C21D 9/40*** | (2006.01) |

(52) U.S. Cl.

CPC . *C23C 8/22* (2013.01); *C21D 1/06* (2013.01); *C21D 1/32* (2013.01); *C21D 1/76* (2013.01); *C21D 6/00* (2013.01); *C21D 9/40* (2013.01); *C22C 38/001* (2013.01); *C22C 38/04* (2013.01); *C22C 38/06* (2013.01); *C22C 38/34* (2013.01)

(58) Field of Classification Search

CPC ..... C22C 38/34

See application file for complete search history.

(56) References Cited

U.S. PATENT DOCUMENTS

| | | | | |
|---|---|---|---|---|
| 2005/0173026 | A1* | 8/2005 | Taniguchi | C23C 8/80 148/233 |
| 2010/0139811 | A1 | 6/2010 | Kozawa et al. | |
| 2011/0036463 | A1* | 2/2011 | Miyanishi et al. | 148/319 |

FOREIGN PATENT DOCUMENTS

| | | | | |
|---|---|---|---|---|
| JP | 6-145897 | A | 5/1994 | |
| JP | 08311607 | A * | 11/1996 | C22C 38/00 |
| JP | 2003-268497 | A | 9/2003 | |
| JP | 2005-48270 | A | 2/2005 | |
| JP | 2005048270 | A * | 2/2005 | C22C 38/00 |
| JP | 2008-280610 | A | 11/2008 | |
| KR | 2009-0121308 | A | 11/2009 | |
| WO | WO 2010/116670 | A1 | 10/2010 | |
| WO | WO 2010116670 | A1 * | 10/2010 | |

OTHER PUBLICATIONS

English machine translation of JP 08-311607 A of Murai, Nov. 26, 1996.*

International Search Report issued in PCT/JP2011/078275, dated Mar. 13, 2012.

Naito, et al., "On the Heat-Treatment Characteristics of Containing Silicon—Nickel—Chromium—Molybdenum Carburizing Steel", The Iron and Steel Institute of Japan, 1972, vol. 58, No. 7, pp. 921-931.

* cited by examiner

*Primary Examiner* — Roy King
*Assistant Examiner* — Jophy S Koshy
(74) *Attorney, Agent, or Firm* — Birch, Stewart, Kolasch & Birch, LLP

(57) ABSTRACT

The present invention provides a steel product for gas carburizing used for manufacturing a carburized steel part. In the above steel product for gas carburizing, a composition of a base metal contains, in mass %, C: 0.1 to 0.4%, Si: exceeding 1.2 to 4.0%, Mn: 0.2 to 3.0%, Cr: 0.5 to 5.0%, Al: 0.005 to 0.1%, S: 0.001 to 0.3%, N: 0.003 to 0.03%, and O: limited to 0.0050% or less, and P: limited to 0.025% or less, and when the contents of Si, Mn, and Cr (mass %) are set to [Si %], [Mn %], and [Cr %], Expression (1) below is satisfied, and an alloy shortage layer satisfying Expression (2) below exists in a range from its surface to 2 to 50 μm in depth.

$$32 \geq 3.5[\text{Si }\%]+[\text{Mn }\%]+3[\text{Cr }\%]>9 \quad (1)$$

$$3.5[\text{Si }\%]+[\text{Mn }\%]+3[\text{Cr }\%] \leq 9 \quad (2)$$

9 Claims, 3 Drawing Sheets

IMCOMPLETELY
HARDENED LAYER

IMCOMPLETELY
HARDENED LAYER

GAS-CARBURIZED STEEL PART EXCELLENT IN SURFACE FATIGUE STRENGTH, STEEL PRODUCT FOR GAS CARBURIZING, AND MANUFACTURING METHOD OF GAS-CARBURIZED STEEL PART

TECHNICAL FIELD

The present invention relates to a gas-carburized steel part excellent in surface fatigue strength, and further relates to a steel product for gas carburizing used for manufacturing the above gas-carburized steel part and a manufacturing method of a gas-carburized steel part using the steel product.

BACKGROUND ART

Steel parts such as a gear and a bearing are used in a severe environment where they are subjected to a large load by transmission of torque or the like. For this reason, high fatigue strength and abrasion resistance are required for the above-described steel parts. After being formed into a shape to be used, these steel parts are subjected to a surface hardening treatment to have the required high fatigue strength and abrasion resistance provided thereto while securing the internal toughness.

Si in steel exhibits high resistance to temper softening in high carbon martensite, so that for achieving an increase in strength of surface fatigue strength, the content of Si is desirably increased. For example, in Patent Document 1, there has been disclosed a technique in which the content of Si in steel is set to 0.5 to 3.0% and vacuum carburizing is performed. However, the vacuum carburizing has disadvantages in that a continuous treatment is difficult to be performed, tarring occurs, it is difficult to control part properties, and so on, and thus it is difficult to achieve mass production.

In contrast to this, gas carburizing does not have these disadvantages, and as a surface hardening treatment intended for mass production, the gas carburizing is more preferable than the vacuum carburizing.

However, Si in the steel deteriorates carburizing performance in the gas carburizing. The deterioration of carburizing performance means that under the same carburizing condition, the depth of a hardened layer obtained by the carburizing is inferior to that of a case hardened steel used normally such as a JIS steel SCr420.

For example, Non-Patent Document 1 has reported that with an increase in content of Si, a gas-carburized depth is decreased, and the upper limit of the content of Si to which gas carburizing is applicable is 1.2%. For this reason, the development of a technique making gas carburizing possible on a high Si-containing steel has been desired.

PRIOR ART DOCUMENT

[Patent Document]

[Patent Document 1] Japanese Laid-open Patent Publication No. 2008-280610

[Non-Patent Document]

[Non-Patent Document 1] "Testu-to-Hagane" Vol. 58 (1972) No. 7 (Jun. 1, 1972, published by The Iron and Steel Institute of Japan), page 926

DISCLOSURE OF THE INVENTION

Problems to be Solved by the Invention

In consideration of the above circumstances, the present invention has an object to provide a steel part preventing resistance to temper softening from decreasing and having excellent surface fatigue strength. Further, the present invention has an object to provide a steel product for gas carburizing suitable for manufacturing the above steel part and a manufacturing method of a gas-carburized steel part.

Means for Solving the Problems

When the content of Si in a steel product is increased as described above, the resistance to temper softening improves, but the gas carburizing performance deteriorates. Then, the present inventors earnestly studied a method in which the gas carburizing performance does not deteriorate even though the content of Si is increased.

As a result, there obtained the knowledge in which in order to improve the resistance to temper softening, Expression (1) below is required to be satisfied when the contents of Si, Mn, and Cr (mass %) in the steel product are set to [Si %], [Mn %], and [Cr %].

$$32 \geq 3.5[\text{Si }\%]+[\text{Mn }\%]+3[\text{Cr }\%]>9 \quad (1)$$

Further, there obtained the knowledge in which in order to prevent the gas carburizing performance from deteriorating even though the content of Si is increased, an alloy shortage layer satisfying Expression (2) below is required to exist in a range from the surface of the steel product to 2 to 50 μm in depth.

$$3.5[\text{Si }\%]+[\text{Mn }\%]+3[\text{Cr }\%] \geq 9 \quad (2)$$

The present invention has been made based on the above-described knowledge, and the gist of the present invention is as follows.

(1) A gas-carburized steel part having a gas-carburized layer containing C: 0.50 mass % or more on a surface thereof includes: a composition of a base metal contains, in mass %, C: 0.1 to 0.4%, Si: exceeding 1.2 to 4.0%, Mn: 0.2 to 3.0%, Cr: 0.5 to 5.0%, Al: 0.005 to 0.1%, S: 0.001 to 0.3%, N: 0.003 to 0.03%, and O: limited to 0.0050% or less, and P: limited to 0.025% or less, when the contents of Si, Mn, and Cr (mass %) are set to [Si %], [Mn %], and [Cr %], Expression (1) below is satisfied, and an alloy shortage layer satisfying Expression (2) below exists in a range from the surface to 2 to 50 μm in depth.

$$32 \geq 3.5[\text{Si }\%]+[\text{Mn }\%]+3[\text{Cr }\%]>9 \quad (1)$$

$$3.5[\text{Si }\%]+[\text{Mn }\%]+3[\text{Cr }\%] \leq 9 \quad (2)$$

(2) The gas-carburized steel part according to (1), in which the composition of the base metal further contains, in mass %, one type or two types or more of Nb: 0.01 to 0.3%, Ti: 0.01 to 0.3%, and V: 0.01 to 0.3%.

(3) The gas-carburized steel part according to (1), in which the composition of the base metal further contains, in mass %, one type or two types or more of Ni: 0.2 to 3.0%, Cu: 0.2 to 3.0%, Co: 0.2 to 3.0%, Mo: 0.05 to 0.4%, W: 0.05 to 0.4%, and B: 0.0006 to 0.005%.

(4) The gas-carburized steel part according to (1), in which the composition of the base metal further contains, in mass %, one type or two types or more of Nb: 0.01 to 0.3%, Ti: 0.01 to 0.3%, and V: 0.01 to 0.3%, and one type or two types or more of Ni: 0.2 to 3.0%, Cu: 0.2 to 3.0%, Co: 0.2 to 3.0%, Mo: 0.05 to 0.4%, W: 0.05 to 0.4%, and B: 0.0006 to 0.005%.

(5) A steel product for gas carburizing used for manufacturing a carburized steel part, the steel part for gas carburizing includes: in mass %, C: 0.1 to 0.4%, Si: exceeding 1.2 to 4.0%, Mn: 0.2 to 3.0%, Cr: 0.5 to 5.0%, Al: 0.005 to 0.1%, S: 0.001 to 0.3%, N: 0.003 to 0.03%, and O: limited to 0.0050% or less, and P: limited to 0.025% or less, in which when the contents of Si, Mn, and Cr (mass %) are set to [Si %], [Mn %], and [Cr %], Expression (1) below is satisfied.

$$32 \geq 3.5[\text{Si }\%]+[\text{Mn }\%]+3[\text{Cr }\%]>9 \quad (1)$$

(6) The steel product for gas carburizing according to (5), further includes: in mass %, one type or two types or more of Nb: 0.01 to 0.3%, Ti: 0.01 to 0.3%, and V: 0.01 to 0.3%.

(7) The steel product for gas carburizing according to (5), further includes: in mass %, one type or two types or more of Ni: 0.2 to 3.0%, Cu: 0.2 to 3.0%, Co: 0.2 to 3.0%, Mo: 0.05 to 0.4%, W: 0.05 to 0.4%, and B: 0.0006 to 0.005%.

(8) The steel product for gas carburizing according to (5), further includes: in mass %, one type or two types or more of Nb: 0.01 to 0.3%, Ti: 0.01 to 0.3%, and V: 0.01 to 0.3%, and one type or two types or more of Ni: 0.2 to 3.0%, Cu: 0.2 to 3.0%, Co: 0.2 to 3.0%, Mo: 0.05 to 0.4%, W: 0.05 to 0.4%, and B: 0.0006 to 0.005%.

(9) A steel product for gas carburizing used for manufacturing a carburized steel part, in which a composition of a base metal contains, in mass %, C: 0.1 to 0.4%, Si: exceeding 1.2 to 4.0%, Mn: 0.2 to 3.0%, Cr: 0.5 to 5.0%, Al: 0.005 to 0.1%, S: 0.001 to 0.3%, N: 0.003 to 0.03%, and O: limited to 0.0050% or less, and P: limited to 0.025% or less, when the contents of Si, Mn, and Cr (mass %) are set to [Si %], [Mn %], and [Cr %], Expression (1) below is satisfied, and an alloy shortage layer satisfying Expression (2) below exists in a range from its surface to 2 to 50 μm in depth.

$$32 \geq 3.5[\text{Si }\%]+[\text{Mn }\%]+3[\text{Cr }\%]>9 \quad (1)$$

$$3.5[\text{Si }\%]+[\text{Mn }\%]+3[\text{Cr }\%] \leq 9 \quad (2)$$

(10) The steel product for gas carburizing according to (9), in which the composition of the base metal further contains, in mass %, one type or two types or more of Nb: 0.01 to 0.3%, Ti: 0.01 to 0.3%, and V: 0.01 to 0.3%.

(11) The steel product for gas carburizing according to (9), in which the composition of the base metal further contains, in mass %, one type or two types or more of Ni: 0.2 to 3.0%, Cu: 0.2 to 3.0%, Co: 0.2 to 3.0%, Mo: 0.05 to 0.4%, W: 0.05 to 0.4%, and B: 0.0006 to 0.005%.

(12) The steel product for gas carburizing according to (9), in which the composition of the base metal further contains, in mass %, one type or two types or more of Nb: 0.01 to 0.3%, Ti: 0.01 to 0.3%, and V: 0.01 to 0.3%, and one type or two types or more of Ni: 0.2 to 3.0%, Cu: 0.2 to 3.0%, Co: 0.2 to 3.0%, Mo: 0.05 to 0.4%, W: 0.05 to 0.4%, and B: 0.0006 to 0.005%.

(13) A manufacturing method of a gas-carburized steel part using a steel product for gas carburizing containing, in mass %, C: 0.1 to 0.4%, Si: exceeding 1.2 to 4.0%, Mn: 0.2 to 3.0%, Cr: 0.5 to 5.0%, Al: 0.005 to 0.1%, S: 0.001 to 0.3%, N: 0.003 to 0.03%, and O: limited to 0.0050% or less, and P: limited to 0.025% or less and in which when the contents of Si, Mn, and Cr (mass %) are set to [Si %], [Mn %], and [Cr %], Expression (1) below is satisfied, the manufacturing method includes: performing primary carburizing in which the steel product for gas carburizing is subjected to a heat treatment under an atmosphere where an oxide layer is formed; removing the oxide layer formed on a surface; and then, performing secondary carburizing in a carburizing atmosphere.

$$32 \geq 3.5[\text{Si }\%]+[\text{Mn }\%]+3[\text{Cr }\%]>9 \quad (1)$$

(14) The steel product for gas carburizing according to (13), in which by the primary carburizing, an alloy shortage layer satisfying Expression (2) below is formed in a range from the surface of the steel product for gas carburizing to 2 to 50 μm in depth.

$$3.5[\text{Si }\%]+[\text{Mn }\%]+3[\text{Cr }\%] \leq 9 \quad (2)$$

(15) The manufacturing method of the gas-carburized steel part according to (13), in which the steel product for gas carburizing further contains, in mass %, one type or two types or more of Nb: 0.01 to 0.3%, Ti: 0.01 to 0.3%, and V: 0.01 to 0.3%.

(16) The manufacturing method of the gas-carburized steel part according to (13), in which the steel product for gas carburizing further contains, in mass %, one type or two types or more of Ni: 0.2 to 3.0%, Cu: 0.2 to 3.0%, Co: 0.2 to 3.0%, Mo: 0.05 to 0.4%, W: 0.05 to 0.4%, and B: 0.0006 to 0.005%.

(17) The manufacturing method of the gas-carburized steel part according to (13), in which the steel product for gas carburizing further contains, in mass %, one type or two types or more of Nb: 0.01 to 0.3%, Ti: 0.01 to 0.3%, and V: 0.01 to 0.3%, and one type or two types or more of Ni: 0.2 to 3.0%, Cu: 0.2 to 3.0%, Co: 0.2 to 3.0%, Mo: 0.05 to 0.4%, W: 0.05 to 0.4%, and B: 0.0006 to 0.005%.

Effect of the Invention

According to the present invention, it is possible to provide a steel part preventing resistance to temper softening from decreasing and having excellent surface fatigue strength. Further, according to the present invention, it is possible to provide a steel product for gas carburizing suitable for manufacturing the above steel part and a manufacturing method of a gas-carburized steel part.

MODE FOR CARRYING OUT THE INVENTION

Figure 1:
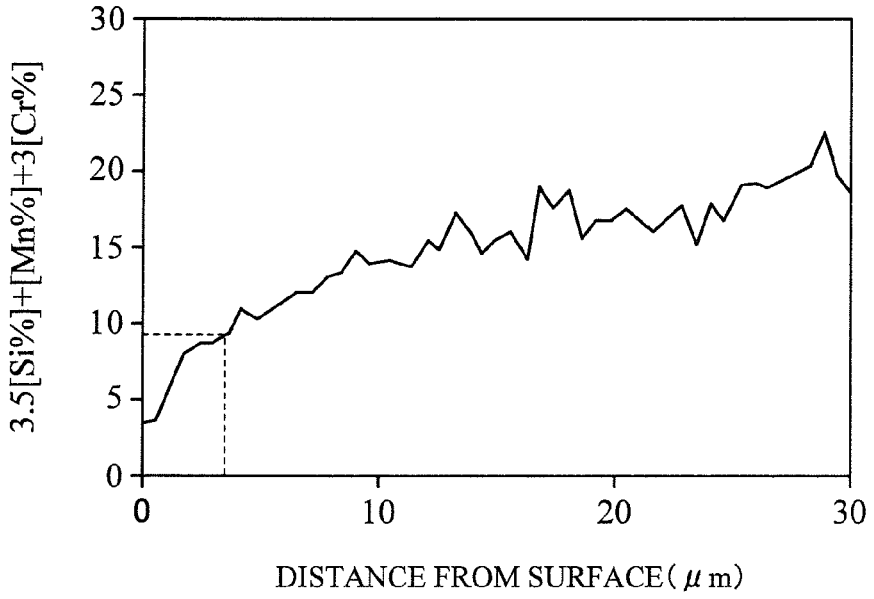
FIG. 1 is a view showing one example of distribution of 3.5[Si %]+[Mn %]+3[Cr %] from a surface.

When the content of Si in steel is increased, resistance to temper softening improves, but gas carburizing performance deteriorates. As a result that the present inventors examined the cause of the deterioration of gas carburizing performance, it turned out that an oxide layer formed on a surface in the early stage of gas carburizing and mainly composed of one type or two types or more of Si, Mn, and Cr affects the deterioration of gas carburizing performance.

That is, it is conceivable that Si, Mn, and Cr oxides stably exist in an atmosphere at the time of carburizing and the oxides exist in a layer state, and thereby gas carburization reaction of a steel product is inhibited. Then, from the examination conducted by the present inventors, it turned out that when the contents of Si, Mn, and Cr (mass %) are set to [Si %], [Mn %], and [Cr %] and 3.5[Si %]+[Mn %]+3[Cr %]>9 is established, the oxide layer is formed on the surface of the steel product to thereby deteriorate the gas carburizing performance.

Then, in order to improve the deterioration of gas carburizing performance caused by the oxide layer to invent a steel part having excellent surface fatigue strength, the present inventors thought that after the oxide layer being formed, the oxide layer is removed by a mechanical method (for example, mechanical polishing), thereby making gas carburizing possible even though the content of Si is large.

Then, in accordance with this idea, steel products based on components causing the deterioration of carburizing performance by the effect of the oxide layer were used to be subjected to a heat treatment under an atmosphere of the oxide layer being formed (primary carburizing). Next, the steel product from which the oxide layer has been removed and the steel product from which the oxide layer has not been removed were subjected to a gas carburizing treatment (secondary carburizing) to examine their gas carburizing performance.

As a result, it turned out that the carburizing performance of the steel product from which the oxide layer has not been removed hardly changes, but the carburizing performance of the steel product from which only the oxide layer has been removed is improved. This is conceivable that when the oxide layer is formed in the primary carburizing, solid-solution alloy elements (Si, Mn, and Cr) in the steel are consumed by oxidation, and consequently a shortage layer of the alloy elements formed on the surface of the steel product greatly affects the carburizing performance.

That is, when only the oxide layer is removed after the primary carburizing, on the surface of the steel product exposed to the atmosphere, the solid solution amount of the alloy elements has been decreased and the contents of the alloy elements (Si, Mn, and Cr) contributing to oxidation are decreased. For this reason, it is conceivable that a new oxide layer is not formed easily.

From the above, from the steel product based on the components causing the deterioration of carburizing performance by the formation of the oxide layer: 3.5[Si %]+[Mn %]+3[Cr %]≤9, only the oxide layer was removed after the primary carburizing, and then a steel product having an alloy shortage layer defined by a chemical composition range: 3.5[Si %]+[Mn %]+3[Cr %]≤9 exist in a range from its surface to 2 to 50 μm in depth was obtained. It turned out that the alloy shortage layer exists on the surface of the above steel product, thereby making the gas carburizing (secondary carburizing) possible.

Further, as a result of the examination of a correlation between the content of Si and the gas carburizing performance, it turned out that when the content of Si in the steel product (base metal) exceeds 1.2%, by the gas carburizing, a steel part excellent in surface fatigue strength can be obtained.

A steel product for gas carburizing of the present invention, (which is sometimes called a "present invention steel product" hereinafter), has been made based on the above knowledge, and contains, in mass %, C: 0.1 to 0.4%, Si: exceeding 1.2 to 4.0%, Mn: 0.2 to 3.0%, Cr: 0.5 to 5.0%, Al: 0.005 to 0.1%, S: 0.001 to 0.3%, N: 0.003 to 0.03%, and O: limited to 0.0050% or less and P: limited to 0.025% or less, in which when the contents of Si, Mn, and Cr (mass %) are set to [Si %], [Mn %], and [Cr %], Expression (1) below is satisfied.

$$32 \geq 3.5[\text{Si }\%]+[\text{Mn }\%]+3[\text{Cr }\%]>9 \quad (1)$$

Further, the steel product for gas carburizing of the present invention can also employ a form in which an alloy shortage layer satisfying Expression (2) below exists in a range from the surface to 2 to 50 μm in depth.

$$3.5[\text{Si }\%]+[\text{Mn }\%]+3[\text{Cr }\%] \leq 9 \quad (2)$$

First, the reason for defining the chemical composition of the steel product for gas carburizing of the present invention will be explained. Hereinafter, % in the chemical composition means mass %.

C: 0.1 to 0.4%

C is an element necessary for maintaining the strength of the steel. The content of C determines the strength of a core portion and also affects the depth of an effective hardened layer. The lower limit of C is set to 0.1% in order to secure the required strength of the core portion. On the other hand, if the content of C is too large, the toughness decreases, so that the upper limit of C is set to 0.4%. C is preferably 0.15 to 0.25%.

Si: Exceeding 1.2 to 4.0%

Si is an element effective for deoxidation of the steel, and is an element effective for providing the necessary strength and hardenability, and further is an element effective for improving the resistance to temper softening. In order to obtain the addition effect of Si, the lower limit of Si is set to be larger than 1.2%. On the other hand, if the content of Si exceeds 4.0%, decarburizing at the time of forging becomes remarkable, so that the upper limit of Si is set to 4.0%. Si is preferably 1.2 to 2.5%.

Mn: 0.2 to 3.0%

Mn is an element effective for deoxidation, and is an element effective for providing the necessary strength and hardenability. Further, Mn is an element that fixes S being an impurity element inevitably mixed in the steel as MnS to make it harmless. In order to secure the addition effect of Mn, the lower limit of Mn is set to 0.2%. On the other hand, if the content of Mn exceeds 3.0%, even though a sub-zero treatment is performed, retained austenite stably exists and the strength is decreased, and thus the upper limit of Mn is set to 3.0%. Mn is preferably 0.5 to 1.5%.

Cr: 0.5 to 5.0%

Cr is an element effective for improving the hardenability, and is an element effective also for improving the resistance to temper softening. In order to obtain the addition effect of Cr, the lower limit of Cr is set to 0.5%. On the other hand, if the content of Cr exceeds 5.0%, the hardness increases and the cold workability deteriorates, and thus the upper limit of Cr is set to 5.0%. Cr is preferably 0.8 to 2.5%.

Al: 0.005 to 0.1%

Al is an element effective for deoxidation, and is an element that precipitates as nitrides to produce an effect of making crystal grains fine. In order to obtain the addition effect of Al, the lower limit of Al is set to 0.005%. On the other hand, if the content of Al exceeds 0.1%, precipitates are coarsened to cause embrittlement, and thus the upper limit of Al is set to 0.1%. Al is preferably 0.01 to 0.05%.

S: 0.001 to 0.3%

S is an impurity element to be inevitably mixed in the steel, but is an element effective for improving the machinability. In order to secure the required machinability, the lower limit of S is set to 0.001%. On the other hand, if the content of S exceeds 0.3%, the forgeability deteriorates remarkably, and thus the upper limit of S is set to 0.3%. S is preferably 0.001 to 0.1%.

N: 0.003 to 0.03%

N is an element to be inevitably mixed in the steel, but is an element that forms chemical compounds with Al to produce an effect of making crystal grains fine. In order to obtain the effect of making crystal grains fine, the lower limit of N is set to 0.003%. On the other hand, if the content of N exceeds 0.03%, the forgeability deteriorates remarkably, and thus the upper limit of N is set to 0.03%.

O: 0.0050% or Less

O exists in the steel as oxide-based inclusions such as alumina and titania. If the content of O is large, the oxides are increased in size, and damage starting from the oxides is caused in a power transmission part, and thus O is required to be limited to 0.0050% or less. The smaller the content of O is, the more preferable it is, and thus O is desirably 0.0020% or less, and is more desirably 0.0015% or less when the long life is desired.

P: 0.025% or Less

P is a component to be contained in the steel as an impurity, and segregates in grain boundaries to decrease the toughness, and thus P is required to be decreased as much as possible and is limited to 0.025% or less. The smaller the content of P is, the more preferable it is, and thus P is desirably 0.020% or less, and is more desirably 0.015% or less when the long life is desired Besides, to the present invention steel product, one type or two types or more of Nb, Ti, and V may also be added for the purpose of making crystal grains finer and preventing crystal grains from coarsening.

Nb: 0.01 to 0.3%

Ti: 0.01 to 0.3%

V: 0.01 to 0.3%

Nb, Ti, and V form chemical compounds with C or N to exhibit an effect of making crystal grains fine, and thus 0.01% or more of one type or two types or more of Nb, T, and V is added. However, even though each of the elements is added in excess of the above-described upper limit, the effect of making crystal grains fine is saturated, and additionally, the productivities of hot rolling, hot forging, cutting, and so on are decreased, and thus the upper limit of each of Nb, Ti, and V is set to 0.3%. Each of N, Ti, and V is preferably 0.02 to 0.1%.

To the present invention steel product, one type or two types or more of Ni, Cu, Co, Mo, W, and B may also be added for the purpose of further improving the hardenability.

Ni: 0.2 to 3.0%

Cu: 0.2 to 3.0%

Co: 0.2 to 3.0%

Mo: 0.05 to 0.4%

W: 0.05 to 0.4%

B: 0.0006 to 0.005%

Ni, Cu, and Co are elements effective for improving the hardenability. In order to obtain the addition effect of Ni, Cu, and Co, 0.2% or more of each of Ni, Cu, and Co is added, but if the added amount of each of Ni, Cu, and Co exceeds 3.0%, the addition effect is saturated to be disadvantageous economically, and thus the upper limit of each of Ni, Cu, and Co is set to 3.0%. Each of Ni, Cu, and Co is preferably 0.2 to 2.0%.

Mo, W, and B are also elements effective for improving the hardenability. In order to obtain the addition effect of Mo, W, and B, 0.05% or more of each of Mo and W is added, and 0.0006% or more of B is added. However, if the added amount of each of Mo and W exceeds 0.4%, the addition effect is saturated to be disadvantageous economically, and thus the upper limit of each of Mo and W is set to 0.4%. If the added amount of B exceeds 0.005%, B chemical compounds precipitate in grain boundaries and the toughness decreases, and thus the upper limit of B is set to 0.005%.

Each of Mo and W is preferably 0.10 to 0.3%. B is preferably 0.0006 to 0.001%.

Next, the chemical composition (Si, Mn, and Cr) of the steel product forming the oxide layer to deteriorate the carburizing performance will be explained.

As a result that the present inventors performed elemental analysis of the oxide layer by using a characteristic X ray, it was confirmed that Si, Mn, Cr, and O exist in the oxide layer.

Si, Mn, and Cr are elements each having a strong tendency to oxidation. As for the components other than Si, Mn, and Cr, the elements each having a weak tendency to oxidation (for example, Ni and Cu) do not oxidize, thus having no effect on the formation of the oxide layer, and the elements each having a strong tendency to oxidation (for example, Ti and V) have the minute contents as compared to those of Si, Mn, and Cr, thus having a negligibly small effect on the formation of the oxide layer.

Thus, Si, Mn, and Cr are most connected with the formation of the oxide layer deteriorating the carburizing performance, and in the chemical composition of the present invention steel product, the condition of the chemical composition that forms the oxide layer to deteriorate the carburizing performance can be set only with Si, Mn, and Cr.

The steel product containing C: 0.1 to 0.4%, Al: 0.005 to 0.1%, S: 0.001 to 0.1%, N: 0.003 to 0.03%, O: limited to 0.005% or less, and P: limited to 0.025% or less, Si within a range of 0.1 to 4.0%, Mn within a range of 0.1 to 3.0%, and Cr within a range of 0.1 to 5.0% was forged to be subjected to a heat treatment, and then by machining, a cylindrical test piece having a diameter of 30 mm was made to be subjected to gas carburizing.

The concentration of C in the uppermost surface layer on the level where the deterioration of gas carburizing performance is caused under the same gas carburizing condition (950° C.–carbon potential 0.8) was subjected to multiple regression analysis with each of the concentrations of Si, Mn, and Cr as a factor, and as the critical condition reaching the concentration of C in the case of the normal gas carburizing being performed, Expression (1') below was obtained.

$$3.5[\text{Si }\%]+[\text{Mn }\%]+3[\text{Cr }\%]=9 \quad (1')$$

That is, when the value of 3.5[Si %]+[Mn %]+3[Cr %] exceeds 9, the carburizing performance deteriorates and a decrease in concentration of C is seen. The deterioration of gas carburizing performance caused by the oxide layer begins to appear from the point when the value of 3.5[Si %]+[Mn %]+3[Cr %] exceeds 9, and as the value of 3.5[Si %]+[Mn %]+3[Cr %] increases, the carburizing performance deteriorates.

On the other hand, Si, Mn, and Cr are elements effective for providing the strength and hardenability of the steel product. Further, Si and Cr are elements effective for improving the resistance to temper softening. In order to obtain the strength and resistance to temper softening required for the steel parts such as a gear and a bearing, the value of 3.5 [Si %]+[Mn %]+3 [Cr %] in the base metal is required to exceed 9. However, according to the upper limits of the contents of Si, Mn, and Cr, 32≥3.5[Si %]+[Mn %]+3[Cr %] is established. Thus, in the steel product for gas carburizing of the present invention, Expression (1) below is set to be satisfied.

$$32 \geq 3.5[\text{Si }\%]+[\text{Mn }\%]+3[\text{Cr }\%]>9 \quad (1)$$

However, as described above, when the value of 3.5[Si %]+[Mn %]+3[Cr %] exceeds 9, the oxide layer is formed on the surface of the steel product, and thus the carburizing performance deteriorates. Then, the steel product for gas carburizing of the present invention is desirably a form that has the alloy shortage layer improving the carburizing performance on the surface.

The alloy shortage layer is a region in which the alloy elements are consumed by oxidation and that is formed in the surface layer portion of the steel product and in which the concentration of the alloy is decreased. In the present invention, the existence of the above alloy shortage layer contributes to the improvement of carburizing performance.

In the present invention steel product, the alloy shortage layer is defined as a region where the contents of Si, Mn, and Cr (%) satisfy Expression (2) below.

$$3.5[\text{Si }\%]+[\text{Mn }\%]+3[\text{Cr }\%] \leq 9 \quad (2)$$

The steel product for gas carburizing of the present invention has the alloy shortage layer satisfying Expression (2) formed on the surface thereof, and thereby the gas carburizing performance is improved. The alloy shortage layer as above can be obtained in a manner that the steel product having the value of 3.5[Si %]+[Mn %]+3[Cr %] in the base metal in excess of 9 is subjected to the primary carburizing, and thereafter the oxide layer formed in the primary carburizing is removed. Thus, even though the steel product having had the alloy shortage layer satisfying Expression (2) formed on the surface thereof is subjected to the gas carburizing (secondary carburizing) again, a new oxide layer deteriorating the gas carburizing performance is not formed.

As above, for improving the gas carburizing performance in the secondary carburizing, the alloy shortage layer is required to exist, namely, the contents of Si, Mn, and Cr (%) are required to satisfy Expression (2) above.

However, in order to sufficiently improve the carburizing performance, the value of the left side of Expression (2) above is preferably smaller, and 3.5 [Si %]+[Mn %]+[Cr %]<7 is preferable. Incidentally, the preferable lower limit of the value of the left side is determined according to the equilibrium with the atmosphere of the gas carburizing, and thus it varies depending on the gas carburizing condition, but is preferably 1.0<3.5[Si %]+[Mn %]+3[Cr %].

The steel product for gas carburizing of the present invention has the alloy shortage layer satisfying Expression (2) below in a range from the surface to 2 to 50 μm in depth. The lower limit of the thickness of the alloy shortage layer is set to 2 μm so as to prevent that by the diffusion of the alloy elements from the base metal, the concentration of the alloy shortage layer is increased and the oxide layer deteriorating the carburizing performance is formed. As for the above numerical value of 2 μm, the carburizing condition of the gas carburizing temperature: 950° C. and the carburizing time: 120 minutes is supposed.

However, when the gas carburizing temperature is high or the gas carburizing is performed for a long time, the diffusion length of the alloy elements becomes long, and thus in order to securely improve the carburizing performance, the thickness of the alloy shortage layer is preferably 10 μm or more.

Conversely, when the gas carburizing temperature is low and the carburizing time is short, it is possible to improve the gas carburizing performance even though the thickness of the alloy shortage layer is 2 μm or less. On the other hand, if the thickness of the alloy shortage layer is too thick, an incompletely hardened layer is also thickened, the hardness is decreased, and the fatigue strength is decreased, and thus the upper limit of the thickness of the alloy shortage layer is set to 50 μm.

Next, the present invention steel product and a manufacturing method of a steel part using the present invention steel product will be explained.

First, by an ordinary method, a steel having a composition in the present invention range is melted and cast, and an obtained steel billet or steel ingot is hot worked and shaped to obtain a steel product for gas carburizing. The hot working is hot rolling or hot forging, and may be performed a plurality of times, or the hot working may also be performed in a manner to combine hot rolling and hot forging.

The shaping may be performed by hot forging, cold working such as cold forging, or cutting, or may also be performed in a manner to combine hot forging, cold working, and cutting. The obtained steel product for gas carburizing is subjected to a heat treatment (primary carburizing) in which an oxide layer is formed, and then the oxide layer is removed.

The heat treatment (primary carburizing) is required to be performed in an atmosphere where Fe is not oxidized but Si, Mn, and Cr are selectively oxidized. The atmosphere is a $H_2/H_2O$ atmosphere, a $CO/CO_2$ atmosphere, an inert gas atmosphere containing a minute amount of oxygen, or a low-oxygen partial pressure atmosphere represented by an atmosphere mixed with these atmospheres.

According to the chemical composition of the steel product, the necessary atmosphere is changed, but when the atmosphere is adjusted to the direction of the atmosphere temperature being high and to the direction of the oxygen partial pressure in the atmosphere being high, the alloy shortage layer strongly tends to thick, and thus in the present invention, it is desirable to adjust the atmosphere to the direction of the atmosphere temperature being high and/or to the direction of the oxygen partial pressure in the atmosphere being high.

In an example, by using a carburizing atmosphere, the formation of the alloy shortage layer is achieved. The removing of the formed oxide layer is performed by a mechanical removing method represented by shot peening, a chemical removing method such as chemical polishing or electrolytic polishing, or a method combined with these methods.

The oxide layer is removed, and then the steel product for gas carburizing is subjected to a gas carburizing treatment (secondary carburizing) to manufacture a gas-carburized steel part. Si has an effect of increasing the activity of C in the steel product, and decreases the carburizing amount, and thus as the condition of the secondary carburizing treatment, it is desirable to increase the carbon potential. Further, as the treatment temperature is higher, before and after the carburizing treatment, cutting may also be performed.

Further, before performing the cold working, spheroidizing may also be performed in order to improve the formability. The spheroidizing is desirably performed at 700 to 800° C.

EXAMPLE

Next, an example of the present invention will be described, but the conditions of the example are condition examples employed for confirming the applicability and effects of the present invention, and the present invention is not limited to these condition examples. The present invention can employ various conditions as long as the object of the present invention is achieved without departing from the spirit of the invention.

Steel products 1 to 32 each having a chemical composition shown in Table 1 were subjected to forging and a heat treatment, and thereafter by machining, small roller test pieces each having a cylinder portion having a diameter of 26 mm and a width of 28 mm, and large roller test pieces each having a diameter of 130 mm and a width of 18 mm, and a crowning with R=150 mm on its outer circumference were made.

TABLE 1

| TEST No. | CLASSIFICATION | HEAT TREATMENT | CHEMICAL COMPOSITION (MASS %) C | Si | Mn | P | S | Cr | O | N |
|---|---|---|---|---|---|---|---|---|---|---|
| 1 | INVENTION EXAMPLE | A | 0.20 | 1.70 | 0.77 | 0.016 | 0.015 | 4.51 | 0.004 | 0.017 |
| 2 | INVENTION EXAMPLE | A | 0.21 | 1.21 | 1.53 | 0.015 | 0.030 | 1.49 | 0.003 | 0.025 |
| 3 | INVENTION EXAMPLE | A | 0.35 | 3.10 | 0.50 | 0.021 | 0.099 | 0.51 | 0.002 | 0.007 |
| 4 | INVENTION EXAMPLE | A | 0.11 | 2.20 | 2.30 | 0.017 | 0.002 | 0.52 | 0.002 | 0.011 |
| 5 | INVENTION EXAMPLE | A | 0.27 | 4.00 | 2.99 | 0.025 | 0.299 | 1.02 | 0.001 | 0.003 |
| 6 | INVENTION EXAMPLE | A | 0.17 | 2.54 | 1.32 | 0.005 | 0.008 | 2.50 | 0.003 | 0.021 |
| 7 | INVENTION EXAMPLE | A | 0.28 | 1.84 | 2.21 | 0.012 | 0.210 | 1.21 | 0.005 | 0.015 |
| 8 | INVENTION EXAMPLE | A | 0.10 | 3.49 | 0.95 | 0.005 | 0.005 | 1.56 | 0.001 | 0.029 |
| 9 | INVENTION EXAMPLE | A | 0.15 | 2.01 | 0.99 | 0.016 | 0.025 | 0.89 | 0.004 | 0.009 |
| 10 | INVENTION EXAMPLE | A | 0.19 | 3.51 | 1.48 | 0.022 | 0.009 | 0.76 | 0.004 | 0.011 |
| 11 | INVENTION EXAMPLE | A | 0.22 | 1.22 | 0.30 | 0.005 | 0.102 | 3.01 | 0.002 | 0.020 |
| 12 | INVENTION EXAMPLE | A | 0.30 | 1.79 | 0.41 | 0.024 | 0.013 | 4.02 | 0.001 | 0.014 |
| 13 | INVENTION EXAMPLE | A | 0.25 | 3.25 | 0.51 | 0.013 | 0.099 | 1.99 | 0.003 | 0.008 |
| 14 | INVENTION EXAMPLE | A | 0.19 | 2.00 | 0.79 | 0.011 | 0.051 | 1.51 | 0.005 | 0.029 |
| 15 | INVENTION EXAMPLE | A | 0.35 | 1.75 | 0.50 | 0.012 | 0.102 | 0.99 | 0.001 | 0.015 |
| 16 | INVENTION EXAMPLE | A | 0.35 | 3.72 | 2.95 | 0.017 | 0.017 | 4.72 | 0.001 | 0.004 |
| 17 | INVENTION EXAMPLE | A | 0.20 | 1.50 | 1.75 | 0.013 | 0.015 | 0.90 | 0.001 | 0.004 |
| 18 | INVENTION EXAMPLE | A | 0.27 | 1.90 | 1.50 | 0.009 | 0.003 | 0.80 | 0.003 | 0.012 |
| 19 | INVENTION EXAMPLE | A | 0.12 | 1.25 | 2.00 | 0.015 | 0.001 | 1.20 | 0.001 | 0.011 |
| 20 | INVENTION EXAMPLE | C | 0.29 | 1.34 | 0.81 | 0.021 | 0.018 | 1.21 | 0.001 | 0.006 |
| 21 | COMPARATIVE EXAMPLE | A | 0.23 | 0.25 | 2.99 | 0.014 | 0.012 | 1.82 | 0.002 | 0.025 |
| 22 | COMPARATIVE EXAMPLE | B | 0.20 | 1.70 | 0.77 | 0.016 | 0.015 | 4.51 | 0.004 | 0.017 |
| 23 | COMPARATIVE EXAMPLE | B | 0.27 | 4.00 | 2.99 | 0.025 | 0.299 | 1.02 | 0.001 | 0.003 |
| 24 | COMPARATIVE EXAMPLE | B | 0.17 | 2.54 | 1.32 | 0.005 | 0.008 | 2.50 | 0.003 | 0.021 |
| 25 | COMPARATIVE EXAMPLE | B | 0.28 | 1.84 | 2.21 | 0.012 | 0.210 | 1.21 | 0.005 | 0.015 |
| 26 | COMPARATIVE EXAMPLE | B | 0.30 | 1.79 | 0.41 | 0.024 | 0.013 | 4.02 | 0.001 | 0.014 |
| 27 | COMPARATIVE EXAMPLE | B | 0.25 | 3.25 | 0.51 | 0.013 | 0.099 | 1.99 | 0.003 | 0.008 |
| 28 | COMPARATIVE EXAMPLE | C | 0.20 | 1.70 | 0.77 | 0.016 | 0.015 | 4.51 | 0.004 | 0.017 |
| 29 | REFERENCE EXAMPLE | B | 0.21 | 0.11 | 1.02 | 0.014 | 0.149 | 1.51 | 0.004 | 0.025 |
| 30 | REFERENCE EXAMPLE | B | 0.12 | 1.20 | 0.55 | 0.020 | 0.020 | 1.01 | 0.002 | 0.016 |
| 31 | REFERENCE EXAMPLE | B | 0.32 | 0.20 | 1.50 | 0.009 | 0.011 | 0.94 | 0.003 | 0.005 |
| 32 | REFERENCE EXAMPLE | B | 0.22 | 0.76 | 1.11 | 0.024 | 0.015 | 1.55 | 0.004 | 0.029 |

| TEST No. | CHEMICAL COMPOSITION (MASS %) Al | Ti | V | Nb | Ni | Cu | Co | Mo | W | B |
|---|---|---|---|---|---|---|---|---|---|---|
| 1 | 0.099 | | | | | | | | | |
| 2 | 0.010 | | | | | | | | | |
| 3 | 0.100 | | | | | | | | | |
| 4 | 0.030 | | | | | | | | | |
| 5 | 0.080 | | | | | | | | | |
| 6 | 0.008 | 0.11 | | | | | | | | |
| 7 | 0.091 | | 0.09 | | | | | | | |
| 8 | 0.006 | | | 0.29 | | | | | | |
| 9 | 0.075 | | | 0.03 | | | | | | |
| 10 | 0.031 | | | | 2.99 | | | | | |
| 11 | 0.099 | | | | | 2.98 | | | | |
| 12 | 0.006 | | | | | | 2.98 | | | |
| 13 | 0.051 | | | | | | | 0.39 | | |
| 14 | 0.049 | | | | | | | | 0.40 | |
| 15 | 0.012 | | | | | | | | | 0.0024 |
| 16 | 0.027 | | | | | | | | | |
| 17 | 0.025 | 0.05 | | | | | | | | 0.0020 |
| 18 | 0.035 | | 0.10 | | | | | 0.14 | | |
| 19 | 0.033 | | | 0.04 | 0.70 | | | | | |
| 20 | 0.031 | | | | | | | | | |
| 21 | 0.035 | | | | | | | | | |
| 22 | 0.099 | | | | | | | | | |

TABLE 1-continued

| | | | | | |
|---|---|---|---|---|---|
| 23 | 0.080 | | | | |
| 24 | 0.008 | 0.11 | | | |
| 25 | 0.091 | | 0.09 | | |
| 26 | 0.006 | | | 2.98 | |
| 27 | 0.051 | | | | 0.39 |
| 28 | 0.099 | | | | |
| 29 | 0.010 | | | | |
| 30 | 0.056 | | | | |
| 31 | 0.031 | | | | |
| 32 | 0.090 | | | | |

As for the made roller test pieces, the test pieces No. 1 to 19 and 21 were subjected to a carburizing treatment (heat treatment) A to be prepared for a test. The test pieces No. 22 to 27, and 29 to 32 were subjected to a carburizing treatment (heat treatment) B to be prepared for a test. The test pieces No. 20 and 28 were subjected to a carburizing treatment (heat treatment) C to be prepared for a test.

Carburizing Treatment (Heat Treatment) A:

The test pieces were subjected to "RX gas carburizing of 950° C.–carbon potential 0.8×1 hour→oil hardening (primary carburizing)." Next, the test pieces were subjected to shot peening under the condition of "a shot diameter of 0.2 mm, a shot speed of 70 m/s, and an arc height of 0.6 mm A." Thereafter, the test pieces were subjected to "RX gas carburizing of 950° C.–carbon potential 0.8×2 hours→oil hardening" (secondary carburizing) and subsequently were subjected to a tempering treatment of 150° C.×90 minutes is to be prepared for a test.

Carburizing Treatment (Heat Treatment) B:

The test pieces were subjected to "RX gas carburizing of 850° C.–carbon potential 0.8×1 hour→oil hardening (primary carburizing)." Next, the test pieces were subjected to shot peening under the condition of "a shot diameter of 0.2 mm, a shot speed of 70 m/s, and an arc height of 0.6 mm A." Thereafter, the test pieces were subjected to "RX gas carburizing of 950° C.–carbon potential 0.8×2 hours→oil hardening" (secondary carburizing) and subsequently were subjected to a tempering treatment of 150° C.×90 minutes to be prepared for a test.

Carburizing Treatment (Heat Treatment) C:

The test pieces were subjected to "RX gas carburizing of 950° C.–carbon potential 0.8×150 hours→oil hardening" (primary carburizing). Next, the test pieces were subjected to shot peening under the condition of "a shot diameter of 0.2 mm, a shot speed of 70 m/s, and an arc height of 0.6 mm A." Thereafter, the test pieces were subjected to "RX gas carburizing of 950° C.–carbon potential 0.8×2 hours→oil hardening" (secondary carburizing) and subsequently were subjected to a tempering treatment of 150° C.×90 minutes to be prepared for a test.

In the carburizing treatment A and the carburizing treatment B, it is intended that due to the temperature different of the primary carburizing, the diffusion length is changed, namely the thickness of the alloy shortage layer is changed. The temperature of the primary carburizing and the oxygen partial pressure are lower in the carburizing treatment B than in the carburizing treatment A, and the thickness of the alloy shortage layer becomes thinner in the carburizing treatment B than in the carburizing treatment A. Perhaps the sufficient alloy shortage layer is not formed in the carburizing treatment B.

Incidentally, the evaluation of the value of 3.5[Si %]+[Mn %]+3[Cr %] on the uppermost surface and the evaluation of the concentration of C of the uppermost surface were conducted in a manner to, by an EPMA, measure the concentration distribution of Si, Mn, Cr, and C and to use the concentrations at the position of 30 μm from the surface.

In order to evaluate the surface fatigue strength, a roller pitting fatigue test was conducted by using the large roller test pieces and the small roller test pieces.

In the roller pitting fatigue test, the large roller was pressed against the small roller with a contact pressure set to 2500 MPa of Hertzian stress. Circumferential speed directions of both the rollers at a contact portion were set the same and a slip ratio was set to −40% (was set that the circumferential speed of the contact portion of the large roller is 40% larger than that of the small roller), and then the rollers were rotated. Then, the number of rotations until pitting occurs in the small roller was set to the life.

The temperature of a gear oil supplied to the above-described contact portion was set to 80° C. The occurrence of pitting was detected by an attached vibration meter. The vibration was detected, and then the rotations of both the rollers were stopped to confirm the occurrence of pitting to and the number of rotations. In the case when pitting does not occur even though the number of rotations reaches 10 million times, the small roller can be evaluated to sufficiently have the surface fatigue strength, and thus the test was stopped at 10 million times.

The results of the above evaluation and test are collectively shown in Table 2.

TABLE 2

| TEST No. | CLASSIFICATION | HEAT TREATMENT | 3.5Si + Mn + 3Cr (PARENT PHASE, MASS %) | 3.5Si + Mn + 3Cr (UPPERMOST SURFACE AFTER PRIMARY CARBURIZING, MASS %) | THICKNESS OF ALLOY SHORTAGE LAYER AFTER PRIMARY CARBURIZING (μm) | CONCENTRATION OF C OF THE SURFACE LAYER (MASS %) | ROLLER PITTING FATIGUE TEST LIFE |
|---|---|---|---|---|---|---|---|
| 1 | INVENTION EXAMPLE | A | 20.3 | 1.5 | 2.9 | 0.85 | 10 MILLION TIMES DURABLE |
| 2 | INVENTION EXAMPLE | A | 10.2 | 2.2 | 11.2 | 0.79 | 10 MILLION TIMES DURABLE |

TABLE 2-continued

| TEST No. | CLASSIFICATION | HEAT TREAT-MENT | 3.5Si + Mn + 3Cr (PARENT PHASE, MASS %) | 3.5Si + Mn + 3Cr (UPPERMOST SURFACE AFTER PRIMARY CARBU-RIZING, MASS %) | THICKNESS OF ALLOY SHORTAGE LAYER AFTER PRIMARY CARBU-RIZING (μm) | CONCEN-TRATION OF C OF THE SURFACE LAYER (MASS %) | ROLLER PITTING FATIGUE TEST LIFE |
|---|---|---|---|---|---|---|---|
| 3 | INVENTION EXAMPLE | A | 12.9 | 2.6 | 9.8 | 0.71 | 10 MILLION TIMES DURABLE |
| 4 | INVENTION EXAMPLE | A | 11.6 | 1.8 | 10.5 | 0.75 | 10 MILLION TIMES DURABLE |
| 5 | INVENTION EXAMPLE | A | 20.1 | 1.2 | 3.5 | 0.69 | 10 MILLION TIMES DURABLE |
| 6 | INVENTION EXAMPLE | A | 17.7 | 2.1 | 7.6 | 0.71 | 10 MILLION TIMES DURABLE |
| 7 | INVENTION EXAMPLE | A | 12.3 | 1.8 | 9.8 | 0.80 | 10 MILLION TIMES DURABLE |
| 8 | INVENTION EXAMPLE | A | 17.8 | 2.0 | 7.2 | 0.65 | 10 MILLION TIMES DURABLE |
| 9 | INVENTION EXAMPLE | A | 10.7 | 2.7 | 10.9 | 0.72 | 10 MILLION TIMES DURABLE |
| 10 | INVENTION EXAMPLE | A | 16.0 | 1.5 | 8.3 | 0.70 | 10 MILLION TIMES DURABLE |
| 11 | INVENTION EXAMPLE | A | 13.6 | 1.6 | 9.5 | 0.85 | 10 MILLION TIMES DURABLE |
| 12 | INVENTION EXAMPLE | A | 18.7 | 1.9 | 4.3 | 0.87 | 10 MILLION TIMES DURABLE |
| 13 | INVENTION EXAMPLE | A | 17.9 | 2.4 | 4.3 | 0.74 | 10 MILLION TIMES DURABLE |
| 14 | INVENTION EXAMPLE | A | 12.3 | 3.2 | 10.8 | 0.72 | 10 MILLION TIMES DURABLE |
| 15 | INVENTION EXAMPLE | A | 9.6 | 1.5 | 15.3 | 0.75 | 10 MILLION TIMES DURABLE |
| 16 | INVENTION EXAMPLE | A | 30.1 | 8.8 | 2.1 | 0.55 | 10 MILLION TIMES DURABLE |
| 17 | INVENTION EXAMPLE | A | 9.7 | 2.1 | 13.2 | 0.75 | 10 MILLION TIMES DURABLE |
| 18 | INVENTION EXAMPLE | A | 10.6 | 1.7 | 10.2 | 0.67 | 10 MILLION TIMES DURABLE |
| 19 | INVENTION EXAMPLE | A | 10.0 | 1.5 | 11.5 | 0.76 | 10 MILLION TIMES DURABLE |
| 20 | INVENTION EXAMPLE | C | 9.1 | 1.1 | 46.0 | 0.81 | 10 MILLION TIMES DURABLE |
| 21 | COMPARATIVE EXAMPLE | A | 9.3 | 2.5 | 12.2 | 0.80 | 3.2 MILLION TIMES DURABLE |
| 22 | COMPARATIVE EXAMPLE | B | 20.3 | 12.5 | — | 0.22 | 0.22 MILLION TIMES DURABLE |
| 23 | COMPARATIVE EXAMPLE | B | 20.1 | 13.2 | — | 0.35 | 0.98 MILLION TIMES DURABLE |
| 24 | COMPARATIVE EXAMPLE | B | 17.7 | 9.9 | — | 0.20 | 0.13 MILLION TIMES DURABLE |
| 25 | COMPARATIVE EXAMPLE | B | 12.3 | 7.9 | 0.9 | 0.35 | 1 MILLION TIMES DURABLE |
| 26 | COMPARATIVE EXAMPLE | B | 18.7 | 12.0 | — | 0.32 | 0.78 MILLION TIMES DURABLE |
| 27 | COMPARATIVE EXAMPLE | B | 17.9 | 11.1 | — | 0.31 | 1.2 MILLION TIMES DURABLE |
| 28 | COMPARATIVE EXAMPLE | C | 20.3 | 0.4 | 65 | 0.82 | 0.35 MILLION TIMES DURABLE |
| 29 | REFERENCE EXAMPLE | B | 5.9 | 2.3 | — | 0.88 | 5.6 MILLION TIMES DURABLE |
| 30 | REFERENCE EXAMPLE | B | 7.78 | 3.3 | — | 0.76 | 4.8 MILLION TIMES DURABLE |
| 31 | REFERENCE EXAMPLE | B | 5.02 | 4.3 | — | 0.85 | 5.5 MILLION TIMES DURABLE |
| 32 | REFERENCE EXAMPLE | B | 8.42 | 5.3 | — | 0.81 | 5.6 MILLION TIMES DURABLE |

In FIG. 1, the distribution of "3.5[Si %]+[Mn %]+3[Cr %]" of a surface layer portion of Invention example No. 1 is shown as an example of the distribution of the concentration of a surface layer. As shown in FIG. 1, a decrease in the alloy concentration is seen in the surface layer portion, and the alloy shortage layer is positioned from the surface to 2.9 μm.

As shown in Table 2, in Invention examples No. 1 to 20, the concentration of C of the uppermost surface layer after the second carburizing (secondary carburizing) becomes higher than the content of C in the steel product (base metal), but in Comparative examples No. 22 to 27, the concentration of C of the uppermost surface layer is substantially the same as the content of C in the steel product (base metal) even though Comparative examples No. 22 to 27 each have the same chemical composition as that of Invention examples No. 1, 5 to 7, 12, and 13.

Invention examples No. 1 to 20 each can endure 10 million rotations in the roller pitting fatigue test to thus have the excellent surface fatigue strength. In Comparative example No. 21, the concentration of Si is lower than that determined in the present invention, so that the surface fatigue strength is low. In Comparative example No. 28, the thickness of the alloy shortage layer exceeds the thickness defined in the present invention, so that the he surface fatigue strength is low.

Reference examples No. 29 to 33 are examples where no deterioration of gas carburizing performance is seen before and after shot peening because the contents of Si, Mn, and Cr in the steel product (base metal) do not satisfy the condition of 3.5[Si %]+[Mn %]+3[Cr %]>9 and the oxide layer inhibiting the carburizing performance is not formed.

That is, as shown in Reference examples No. 29 to 33, in the steel product having the contents of Si, Mn, and Cr in the base metal satisfying 3.5[Si %]+[Mn %]+3[Cr %]≤9, the gas carburizing performance does not deteriorate. However, the above steel product cannot sufficiently obtain the strength and resistance to temper softening required for the steel parts such as a gear and a bearing. This point is a technical reason why in the present invention steel product, the contents of Si, Mn, and Cr in the steel product (base metal) are defined to satisfy 3.5[Si %]+[Mn %]+3[Cr %]>9.

From the above results, it is obvious that in Invention examples No. 1 to 20, the carburizing performance has been improved.

This is attributed to the fact that (a) mass % of the chemical composition of the steel product (base metal) falls within a predetermined range (C: 0.1 to 0.4%, Si: exceeding 1.2 to 4.0%, Mn: 0.2 to 3.0%, Cr: 0.5 to 5.0%, Al: 0.005 to 0.1%, S: 0.001 to 0.3%, N: 0.003 to 0.03%, and O: 0.0050% or less and P: 0.025% or less), (b) the contents of Si, Mn, and Cr (%) in the steel product (base metal) satisfy the condition of 3.5[Si %]+[Mn %]+3[Cr %]>9, and (c) the thickness of the alloy shortage layer existing in the surface layer and having the contents of Si, Mn, and Cr (%) satisfying 3.5[Si %]+[Mn %]+3[Cr %]≤9 is 2 to 50 μm.

Figure 2:
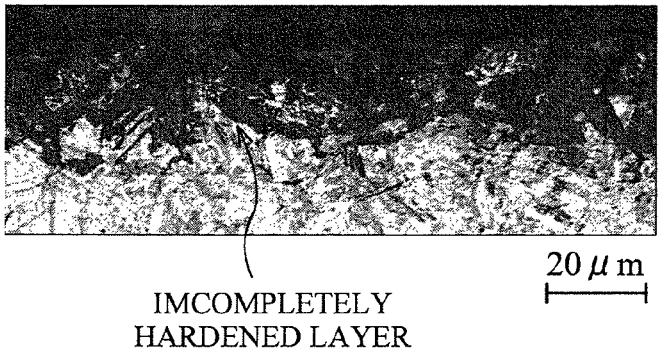
FIG. 2 is a macrophotograph of structure of a surface layer, of a steel product of Reference example No. 29, obtained after primary carburizing.
Figure 3:
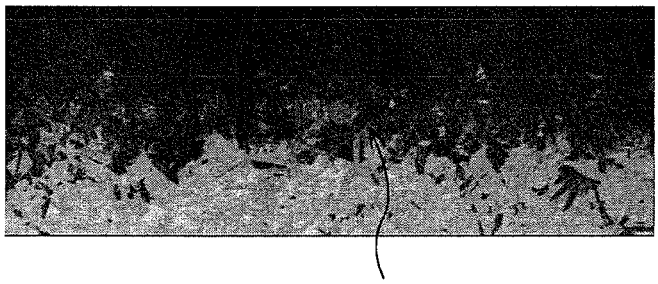
FIG. 3 is a macrophotograph of structure of the surface layer, of the steel product of Reference example No. 29, obtained after secondary carburizing.

The structure of the surface layer after the primary carburizing and the structure of the surface layer after the secondary carburizing observed in the steel product of Invention example No. 9 and the steel product of Reference example No. 29 were as follows. As shown in FIG. 2, in the steel product of Reference example No. 29, an incompletely hardened layer made of mainly pearlite was formed in the surface layer obtained after the primary carburizing. Further, as shown in FIG. 3, in the steel product of Reference example No. 29, an incompletely hardened layer made of mainly pearlite was further formed in the surface layer obtained after the secondary carburizing.

Figure 4:
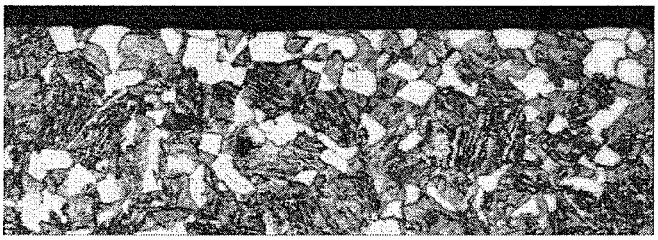
FIG. 4 is a macrophotograph of structure of a surface layer, of a steel product of Invention example No. 9, obtained after primary carburizing.
Figure 5:
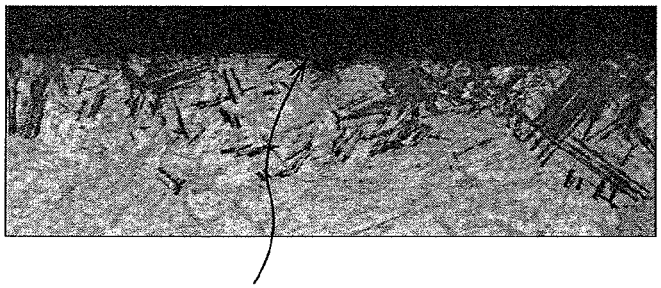
FIG. 5 is a macrophotograph of structure of the surface layer, of the steel product of Invention example No. 9, obtained after secondary carburizing.

On the other hand, as shown in FIG. 4, in the steel product of Invention example No. 9, martensite was formed in the surface layer obtained after the primary carburizing. Further, as shown in FIG. 5, in the steel product of Invention example No. 9, a hardened layer made of mainly martensite is further formed after the secondary carburizing, and as compared to Reference example No. 29 (FIG. 3), the amount of the incompletely hardened layer being formed was decreased.

Figure 6:
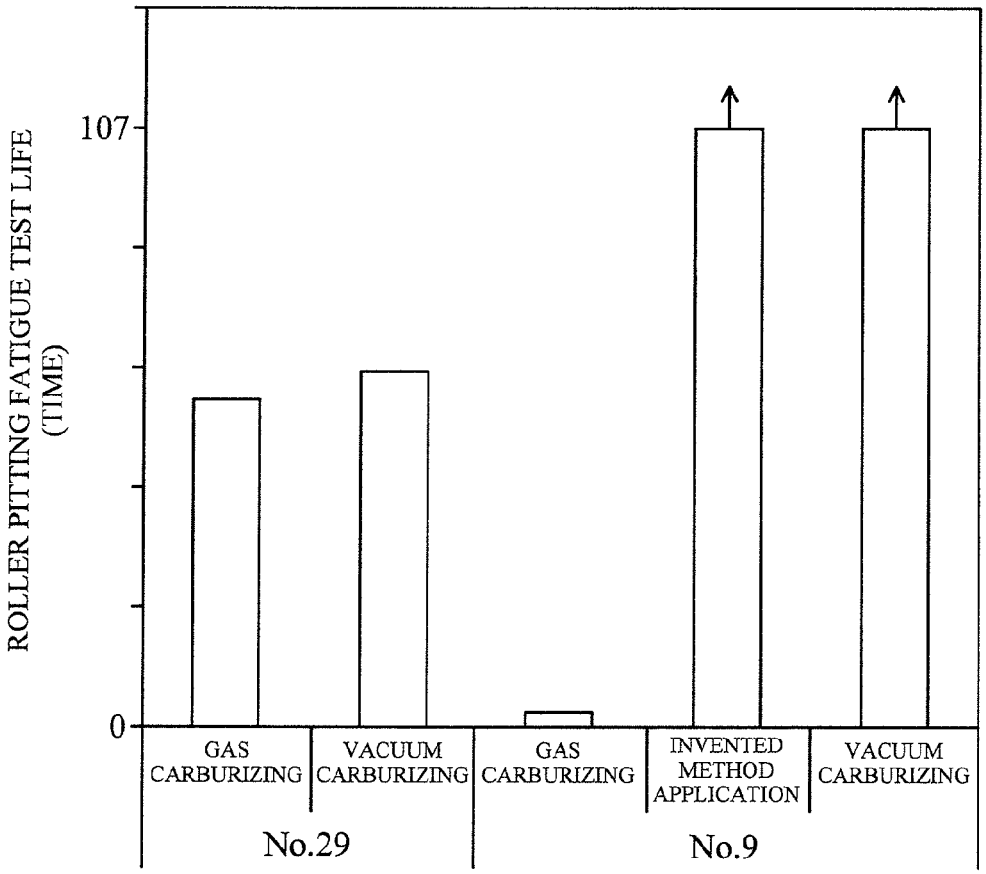
FIG. 6 is a graph in which fatigue lives of the steel product of Invention example No. 9 and the steel product of Reference example No. 29 are compared with respect to respective carburizing treatments in a roller pitting fatigue test.

Further, the fatigue life in the roller pitting fatigue test in the case when the steel product of Invention example No. 9 was subjected to three treatments of gas carburizing, invented method application, and vacuum carburizing, and the fatigue life in the roller pitting fatigue test in the case when the steel product of Reference example No. 29 was subjected to two treatments of gas carburizing and vacuum carburizing were compared. A result of the comparison is shown in FIG. 6. Incidentally, in both the cases of Invention example No. 9 and Reference example No. 29, the condition of the "gas carburizing" is the same as that of the above-described carburizing treatment A. The "invented method application" performed on the steel product of Invention example No. 9 is the above-described carburizing treatment A. Consequently, the steel product of Reference example No. 29 was not able to obtain the sufficient fatigue life. The steel product of Invention example No. 9 was able to, by the "invented method application," obtain the fatigue life equal to that by the vacuum carburizing.

INDUSTRIAL APPLICABILITY

The present invention greatly contributes to achievement of high power, improvement of fuel efficiency, and so on of an automobile, a construction vehicle, an industrial machine, and so on to thus have large industrial applicability.

What is claimed:

1. A gas-carburized steel part comprising:

a gas-carburized layer containing C: 0.50 mass % to 0.87 mass % on a surface thereof and a base metal, wherein the base metal contains, in mass %:

C: 0.1 to 0.29%,
Si: greater than 1.5% to 4.0%,
Mn: 0.2 to 3.0%,
Cr: 0.5 to 5.0%,
Al: 0.005 to 0.1%,
S: 0.001 to 0.3%,
N: 0.003 to 0.03%,
O: limited to 0.0050% or less,
P: limited to 0.025% or less, and
the balance being Fe and unavoidable impurities;

wherein:

Expression (1) is satisfied in the base metal, and the gas-carburized steel part has an alloy shortage layer satisfying Expression (2) below in a range from the surface to 2 to 50 μm in depth;

$$32 \geq 3.5[\text{Si }\%]+[\text{Mn }\%]+3[\text{Cr }\%]>9; \quad \text{Expression (1):}$$

$$3.5[\text{Si }\%]+[\text{Mn }\%]+3[\text{Cr }\%] \leq 9; \quad \text{Expression (2):}$$

wherein [Si %], [Mn %], and [Cr %] in Expressions (1) and (2) represent contents of Si, Mn, and Cr, respectively, in mass %.

2. The gas-carburized steel part according to claim 1, wherein the base metal further contains, in mass %, one or more selected from the group consisting of:

Nb: 0.01 to 0.3%,
Ti: 0.01 to 0.3%, and
V: 0.01 to 0.3%.

3. The gas-carburized steel part according to claim 1, wherein the base metal further contains, in mass %, one or more selected from the group consisting of:

Ni: 0.2 to 3.0%,
Cu: 0.2 to 3.0%,
Co: 0.2 to 3.0%,
Mo: 0.05 to 0.4%,
W: 0.05 to 0.4%, and
B: 0.0006 to 0.005%.

4. The gas-carburized steel part according to claim 1, wherein the base metal further contains, in mass %:

one or more selected from the group consisting of:

Nb: 0.01 to 0.3%,
Ti: 0.01 to 0.3%, and
V: 0.01 to 0.3%, and one or more selected from the group consisting of:

Ni: 0.2 to 3.0%,
Cu: 0.2 to 3.0%,
Co: 0.2 to 3.0%,
Mo: 0.05 to 0.4%,
W: 0.05 to 0.4%, and
B: 0.0006 to 0.005%.

5. The gas-carburized steel part according to claim 1, wherein the base metal contains, in mass %, Si: 1.70 to 4.0%.

6. A method for manufacturing the gas-carburized steel part of claim 1, the manufacturing method comprising:

performing primary carburizing in which a steel product for gas carburizing is subjected to a heat treatment under an atmosphere where an oxide layer is formed;

removing the oxide layer formed on a surface; and then, performing secondary carburizing in a carburizing atmosphere.

7. A method for manufacturing the gas-carburized steel part of claim 2, the manufacturing method comprising:

performing primary carburizing in which a steel product for gas carburizing is subjected to a heat treatment under an atmosphere where an oxide layer is formed;

removing the oxide layer formed on a surface; and then, performing secondary carburizing in a carburizing atmosphere.

8. A method for manufacturing the gas-carburized steel part of claim 3, the manufacturing method comprising:

performing primary carburizing in which a steel product for gas carburizing is subjected to a heat treatment under an atmosphere where an oxide layer is formed;

removing the oxide layer formed on a surface; and then, performing secondary carburizing in a carburizing atmosphere.

9. A method for manufacturing the gas-carburized steel part of claim 4, the manufacturing method comprising:

performing primary carburizing in which a steel product for gas carburizing is subjected to a heat treatment under an atmosphere where an oxide layer is formed;

removing the oxide layer formed on a surface; and then, performing secondary carburizing in a carburizing atmosphere.

* * * * *